US007765973B2

(12) United States Patent
Matsuda

(10) Patent No.: US 7,765,973 B2
(45) Date of Patent: Aug. 3, 2010

(54) MOTORCYCLE PROVIDED WITH VALVE-OPERATING MECHANISM

(75) Inventor: Yoshimoto Matsuda, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 255 days.

(21) Appl. No.: 12/216,148

(22) Filed: Jun. 30, 2008

(65) Prior Publication Data

US 2009/0007863 A1 Jan. 8, 2009

(30) Foreign Application Priority Data

Jul. 2, 2007 (JP) ..... P2007-173875

(51) Int. Cl.
*F01L 3/10* (2006.01)

(52) U.S. Cl. ..... 123/90.65; 123/90.14; 123/90.31; 267/64.11

(58) Field of Classification Search ..... 123/90.12, 123/90.13, 90.65, 90.66, 90.67, 90.14, 90.16, 123/90.31; 267/64.11, 256
See application file for complete search history.

(56) References Cited

U.S. PATENT DOCUMENTS 6,083,140 A * 7/2000 Kimura ..... 477/115

FOREIGN PATENT DOCUMENTS

JP 8-144772 6/1996

* cited by examiner

*Primary Examiner*—Ching Chang
(74) *Attorney, Agent, or Firm*—Wenderoth, Lind & Ponack, L.L.P.

(57) ABSTRACT

The present invention provides a motorcycle having a valve-operating mechanism for actuating a valve which opens and closes a combustion chamber of an internal combustion engine. The valve-operating mechanism includes a biasing means for biasing the valve toward a valve closing direction and a drive means for driving the valve toward the valve opening direction against the biasing means, the biasing means is a gas spring formed by filling a gas spring chamber with compressible gas, and a compressed-gas container for supplying the compressible gas is connected to the gas spring chamber, and the compressed-gas container is disposed in an outermost line of body components of the motorcycle except for the compressed-gas container when the motorcycle is viewed from above.

15 Claims, 13 Drawing Sheets

MOTORCYCLE PROVIDED WITH VALVE-OPERATING MECHANISM

BACKGROUND OF THE INVENTION

1. Field of the Invention

The present invention relates to a motorcycle provided with a valve-operating mechanism for actuating a valve which opens and closes a combustion chamber of an internal combustion engine, particularly to a motorcycle whose valve-operating mechanism includes biasing means for biasing the valve toward a valve closing direction and drive means for driving the valve toward a valve opening direction against the biasing means.

2. Description of the Related Art

In order to correspond to high-speed rotation of the internal combustion engine mounted on the motorcycle, several new technologies are known as follows.

One is a multi-valve structure in which the number of valves per cylinder, that is, the numbers of inlet valves and exhaust valves are increased. Other one is a gas spring type valve-operating mechanism in which compressible gas such as compressed air is used instead of a coil spring as means for biasing the valve toward the valve closing direction (for example, see Japanese Patent Laid-Open Publication No. 8-144772).

The gas spring type valve-operating mechanism has a better capability of following valve opening and closing timing than that of a coil spring type valve-operating mechanism. Additionally, in the gas spring type valve-operating mechanism, generation of machine noise at a high-speed rotation can be suppressed.

In the gas spring type valve-operating mechanism, the need for always filling a gas spring chamber with the compressed gas arises in order to maintain a predetermined compression repulsive force generated by the compressed gas. Therefore, the gas spring type valve-operating mechanism disclosed in Japanese Patent Laid-Open Publication No. 8-144772 includes a compressed-gas container (compressed-air container) or a gas compressor driven by a cam shaft.

In the case where the gas spring type valve-operating mechanism includes the compressed-gas container, the need for providing a drive means does not arise unlike the case where the gas spring type valve-operating mechanism includes the gas compressor. Therefore, the machine noise caused by the drive means is not generated. Additionally, the gas spring type valve-operating mechanism including the compressed-gas container has an advantage from the viewpoint of cost. However, the need for increasing a volume of the compressed-gas container arises when the predetermined compression repulsive force generated by the compressed gas is maintained for a long time.

The motorcycle has a larger exposed portion than an automobile, and the motorcycle has a less storage space for various components and accessories. Therefore, in the case the compressed-gas container having a large capacity is mounted on the motorcycle, not only it is necessary to maintain strength for withstanding a compressed gas pressure, but also it is necessary to make consideration of a contact with an object outside the body, which results in a problem in that the structure becomes complicated to increase production cost while a weight of the compressed-gas container is increased.

SUMMARY OF THE INVENTION

The present invention addresses the above described condition, and an object of the present invention is to provide a motorcycle provided with a valve-operating mechanism, which can be lightened and manufactured in low cost.

In order to accomplish the foregoing object of the present invention, there is in accordance with a first aspect of the invention provides a motorcycle provided with a valve-operating mechanism for actuating a valve which opens and closes a combustion chamber of an internal combustion engine, wherein the valve-operating mechanism includes a biasing means for biasing the valve toward a valve closing direction and a drive means for driving the valve toward the valve opening direction against the biasing means, the biasing means is a gas spring formed by filling a gas spring chamber with compressible gas, and a compressed-gas container for supplying the compressible gas is connected to the gas spring chamber, and the compressed-gas container is disposed in an outermost line of body components of the motorcycle except for the compressed-gas container when the motorcycle is viewed from above.

With this configuration, the contact of the compressed-gas container with the object outside the body can be prevented. Accordingly, the need for setting the strength of the compressed-gas container to an excessively high level can be eliminated, and the production cost can be reduced while the weight reduction is achieved.

In the motorcycle provided with the valve-operating mechanism according to the first aspect of the invention, preferably the compressed-gas container may be disposed in a region opposite to a side to which an exhaust pipe line of a cylinder of the internal combustion engine is connected.

With this configuration, exhaust gas heat in the exhaust pipe +−+ line can be prevented from transferring to the compressed-gas container.

In the motorcycle provided with the valve-operating mechanism according to the first aspect of the invention, preferably the compressed-gas container may be disposed in a rear portion of the cylinder of the internal combustion engine when the motorcycle is laterally viewed.

With this configuration, a small stone struck up by a front wheel hardly hit the compressed-gas container during the driving. Most of the motorcycles in which a single-cylinder or transverse-mounted multi-cylinder internal combustion engine is mounted have a structure in which an exhaust pipe is connected onto a front side of a cylinder head. In above the motorcycle, when the compressed-gas container is disposed at a back of a rear face of the cylinder, the compressed-gas container is located away from the exhaust pipe, so that the exhaust gas heat can be prevented from transferring to the compressed-gas container.

In the motorcycle provided with the valve-operating mechanism according to the first aspect of the invention, preferably the internal combustion engine is a V-type internal combustion engine in which a front cylinder and a rear cylinder are arranged into a V-shape, and the compressed-gas container may be disposed between the front-cylinder and the rear cylinder when the motorcycle is laterally viewed.

With this configuration, the compressed-gas container can be covered in the fore-and-aft direction with the front and rear cylinders. Generally, the V-type internal combustion engine mounted on the motorcycle has a structure in which the exhaust pipes are connected to a front side of the front cylinder and a rear side of the rear cylinder respectively. In the case where the compressed-gas container is disposed between the front cylinder and the rear cylinder when the motorcycle is laterally viewed, the compressed-gas container is disposed while separated from the exhaust pipe of the front cylinder, so that the exhaust gas heat can be prevented from transferring to the compressed-gas container. Particularly, when the compressed-gas container is disposed in a V-bank, the compressed-gas container can be separated from the exhaust pipes of the front cylinder and rear cylinder, and the compact motorcycle can be maintained.

In the motorcycle provided with the valve-operating mechanism according to the first aspect of the invention, preferably the compressed-gas container may be disposed at a position where the compressed-gas container overlaps the body component except for the compressed-gas container when the motorcycle is laterally viewed.

With this configuration, the contact of the compressed-gas container with the outside object can substantially be prevented by the body component.

In the motorcycle provided with the valve-operating mechanism according to the first aspect of the invention, preferably a main frame of the motorcycle is the body component which the compressed-gas container overlaps when the motorcycle is laterally viewed.

With this configuration, the compressed-gas container is substantially covered in the lateral direction with the main frame, so that the contact of the compressed-gas container with the outside object can be prevented by the body component having the strong structure while an appearance is improved.

In the motorcycle provided with the valve-operating mechanism according to the first aspect of the invention, preferably the compressed-gas container is disposed near a gravitational center of a body or the internal combustion engine when the motorcycle is laterally viewed.

With this configuration, the mounting of the compressed-gas container has a little influence on a change in position of a gravitational center of the body or internal combustion engine, so that drivability of the motorcycle can be maintained.

In the motorcycle provided with the valve-operating mechanism according to the first aspect of the invention, preferably the compressed-gas container may be disposed within a lateral width of the internal combustion engine.

With this configuration, the compact motorcycle can be maintained while the contact of the compressed-gas container with the outside object is prevented by the internal combustion engine.

In the motorcycle provided with the valve-operating mechanism according to the first aspect of the invention, preferably a pressure regulating valve is attached to the compressed-gas container, the pressure regulating valve regulating a gas pressure in the gas spring chamber.

With this configuration, the gas pressure of the gas spring chamber can be maintained at an optimum value for opening and closing the valve. Additionally, the pressure regulating valve can compactly be disposed along with compressed-gas container, and the pressure regulating valve can be detachably attached along with the compressed-gas container.

In the motorcycle provided with the valve-operating mechanism according to the first aspect of the invention, preferably a second biasing means for utilizing a restoring force of an elastic material to bias the valve of the combustion chamber toward the valve closing direction is disposed in the gas spring chamber in addition to the biasing means in which the compressible gas is used. Preferably, a relatively-weak coil spring is used as the second biasing means. For example, the second biasing means is a coil spring which has a spring force weaker than that of the biasing means of the compressible gas, and the coil spring can respond to the actuation of the valve during low-speed rotation.

With this configuration, even if the gas pressure of the compressed-gas container is lowered, the actuation of the valve can be maintained by the second biasing means without stopping the internal combustion engine.

In the motorcycle provided with the valve-operating mechanism according to the first aspect of the invention, preferably a gas feeder for supplying the gas to the compressed-gas container may be provided. The gas feeder is rotated with a power generated by running of the internal combustion engine being used as a drive source.

With this configuration, the need for manually injecting the gas into the compressed-gas container in a periodic manner is eliminated to facilitate maintenance. Additionally, the need for providing a specific motor for driving the compressor can be eliminated to cut down the component cost.

In the motorcycle provided with the valve-operating mechanism according to the first aspect of the invention, preferably a supply pipe capable of injecting the gas may be connected to the gas spring chamber in addition to the compressed-gas container.

With this configuration, in the case where the motorcycle is driven again after the motorcycle is stopped for a long time, the compressed-gas container can be filled with the gas in the state in which the internal combustion engine is not driven.

In the motorcycle provided with the valve-operating mechanism according to the first aspect of the invention, preferably the valve and the gas feeder may be configured to be driven by a common cam portion formed on a valve driving cam shaft of the combustion chamber.

With this configuration, the need for providing an additional cam portion for driving the gas feeder is eliminated, so that the valve-operating mechanism can compactly be maintained while the number of components is decreased.

In the motorcycle provided with the valve-operating mechanism according to the first aspect of the invention, preferably a relief valve may be connected to the compressed-gas container. The relief valve prevents a pressure of the compressed-gas container from exceeding a setting range.

With this configuration, the excessive pressure can automatically be prevented in the compressed-gas container.

In the motorcycle provided with a valve-operating mechanism for actuating a valve which opens and closes a combustion chamber of an internal combustion engine, wherein the valve-operating mechanism includes biasing means for biasing the valve toward a valve closing direction and drive means for driving the valve toward the valve opening direction against the biasing means; the biasing means is a gas spring formed by filling a gas spring chamber with compressible gas, and a compressed-gas container supplying the compressible gas is connected to the gas spring chamber; passage forming means for forming a gas passage is connected to the compressed-gas container in order to guide the gas to the gas spring chamber; and the compressed-gas container is disposed such that a compressed-gas container projection region is located inside an outer-shell projection region in a body lateral direction, the compressed-gas container projection region indicating an outer shape of the compressed-gas container projected to a virtual plane perpendicular in a body fore-and-aft direction, the outer-shell projection region being obtained by projecting one or more body component except for the compressed-gas container to the virtual plane.

With this configuration, even if the gas leaks to the outside from the gas spring chamber, the gas is supplied from the compressed-gas container to the gas spring chamber through the gas passage. Therefore, a valve biasing force generated by the biasing means can be prevented from being lowered. Accordingly, the valve biasing force can be maintained for a longer time in comparison with the case where the compressed-gas container is not provided.

Because the compressed-gas container projection region is located inside the outer-shell projection region, the compressed-gas container is laterally disposed inside the body component corresponding to the outer-shell projection region when the motorcycle is viewed from the front side. Therefore, even if the motorcycle is inclined from the perpendicular state, or even if the motorcycle topples over, the body component corresponding to the outer-shell projection region contacts probably with the object such as a ground before the compressed-gas container contacts the object, so that the compressed-gas container can be protected by the body component. Because the contact of the compressed-gas container with the object is prevented in the above-described manner, the need for enhancing the strength of the compressed-gas container is eliminated, and a degree of freedom of selecting the compressed-gas container used in the motorcycle can be increased. For example, the use of the low-strength compressed-gas container can achieve the weight reduction and production cost reduction of the motorcycle provided with the compressed-gas container.

Thus, according to the invention, the contact of the compressed-gas container with the object outside the body can be prevented, and the need for setting the strength of the compressed-gas container to an excessively higher level is eliminated, so that the production cost can be suppressed while the weight reduction is achieved.

BRIEF DESCRIPTION OF THE DRAWINGS

The above and other objects, features and advantages of the present invention will become more apparent from the following description taken in connection with the accompanying drawings, in which:

FIG. 7 is a longitudinal sectional view showing a valve portion of an internal combustion engine of the second embodiment;

FIG. 8 is a perspective view showing an internal combustion engine of the third embodiment;

FIG. 10 is a longitudinal sectional view showing a valve portion of an internal combustion engine of the fourth embodiment;

FIG. 11 is a left side view showing an arrangement relationship among a main frame, an internal combustion engine, and a cylinder in the motorcycle of the fifth embodiment;

FIG. 12 is a left side view showing an arrangement relationship among a main frame, a internal combustion engine, and a cylinder in the motorcycle of the sixth embodiment; FIG. 13 is a right side view showing the motorcycle on which a V-type internal combustion engine is mounted.

DETAILED DESCRIPTION OF THE PREFERRED EMBODIMENTS

First Embodiment

A motorcycle provided with a valve-operating mechanism according to a first embodiment of the invention will be described below with reference to FIGS. 1 to 6.

(Outline of Main Part of Motorcycle)

Figure 1:
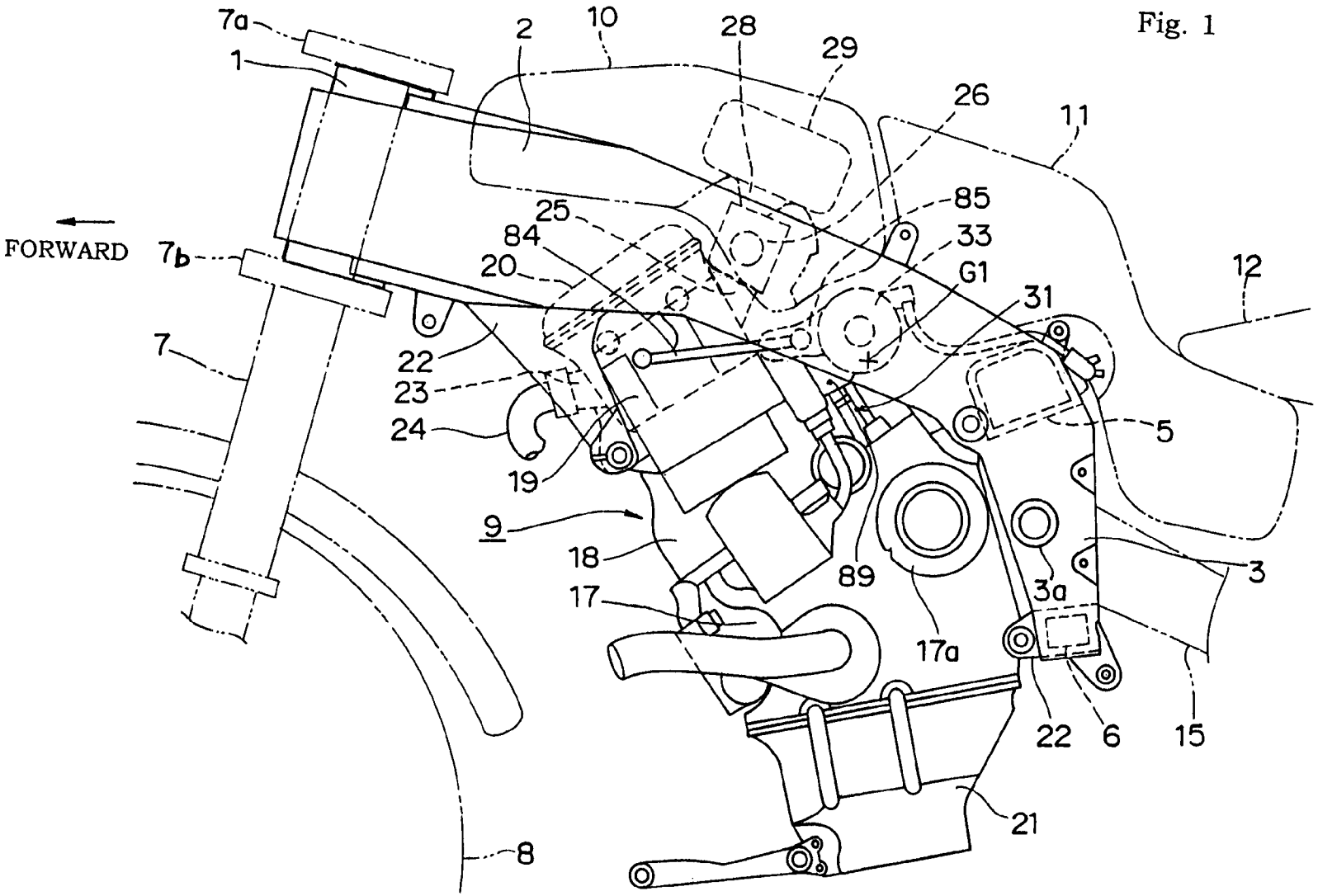
FIG. 1 is a left side view showing a motorcycle provided with a valve-operating mechanism according to a first embodiment of the invention.

FIG. 1 is a left side view showing a motorcycle provided with a valve-operating mechanism according to a first embodiment of the invention. Referring to FIG. 1, a body frame which is of a body component includes a head pipe 1, a pair of right and left main frames 2 and 2, a pair of right and left swing arm brackets 3 and 3, a cross member 5, a cross member 6, a rear frame (not shown), and a seat rail (not shown). The main frames 2 and 2 are extended downward and backward from the head pipe 1. The swing arm brackets 3 and 3 are extended substantially downward from rear end portions of the main frames 2 and 2, and the swing arm brackets 3 and 3 are integral with the main frames 2 and 2. The cross member 5 couples the rear end portions of the lateral main frames 2 and 2 to each other. The cross member 6 couples lower end portions of the swing arm brackets 3 and 3 to each other. The rear frame and the seat rail are extended backward from the main frames 2 and 2 and the swing arm brackets 3 and 3. An internal combustion engine 9 is mounted below the main frames 2 and 2.

A front fork 7 is turnably supported to the head pipe 1 through a steering shaft, an upper bracket 7*a*, and an under bracket 7*b*. A handle (not shown) is provided on the upper bracket 7*a*, and a front wheel 8 is supported by a lower end portion of the front fork 7. An air cleaner box (inlet box) 10 is disposed between the right and left main frames 2 and 2, a fuel tank 11 is disposed on a rear side of the air cleaner box 10, and a seat 12 is disposed on a rear side of the fuel tank 11. A front end portion of a swing arm 15 extended downward and backward is swingably supported in a pivot portion 3*a* of the swing arm bracket 3.

For example, the internal combustion engine 9 is a four-cylinder four-cycle internal combustion engine in which four cylinders are arranged in parallel in a body width direction (right and left width direction). The internal combustion engine 9 includes a crankcase 17, a cylinder block 18 fixed to an upper end of the crankcase 17, a cylinder head 19 fixed to an upper end of the cylinder block 18, a cylinder head cover 20 fixed to an upper end of the cylinder head 19, and an oil pan 21 fixed to a lower surface of the crankcase 17. The internal combustion engine 9 is supported by plural internal combustion engine mounting brackets 22 which are provided on the main frames 2 and 2 and swing arm bracket 3. A rear portion of the crankcase 17 constitutes a transmission case portion 17*a*.

An exhaust opening 23 for each cylinder is opened in a front end face of the cylinder head 19, and an exhaust pipe 24 which is of an exhaust pipe line is connected to each exhaust opening 23. An inlet opening 25 for each cylinder is opened in a rear end face of the cylinder head 19, a throttle body (or carburetor) 26 is connected to each inlet opening 25, and a inlet pipe 28 provided at an upper end of the throttle body 26 is connected to a filter 29. The filter 29 is disposed in the air cleaner box 10. The air cleaner box 10 includes a suction port (not shown).

A breather box 31 is disposed from a rear surface of the cylinder block 18 to an upper end face of the transmission case portion 17*a* of the crankcase 17. In the first embodiment, the breather box 31 is made of a resin independently of the crankcase 17 and cylinder block 18, and the breather box 31 is detachably attached to the crankcase 17 and cylinder block 18. Alternatively, the breather box 31 made of aluminum or an aluminum alloy may be integral with the crankcase 17 and cylinder block 18.

A compressed-gas container 33 is disposed on a rear side of the breather box 31 in order to supply compressible gas to a valve-operating mechanism of the internal combustion engine 9.

Figure 2:
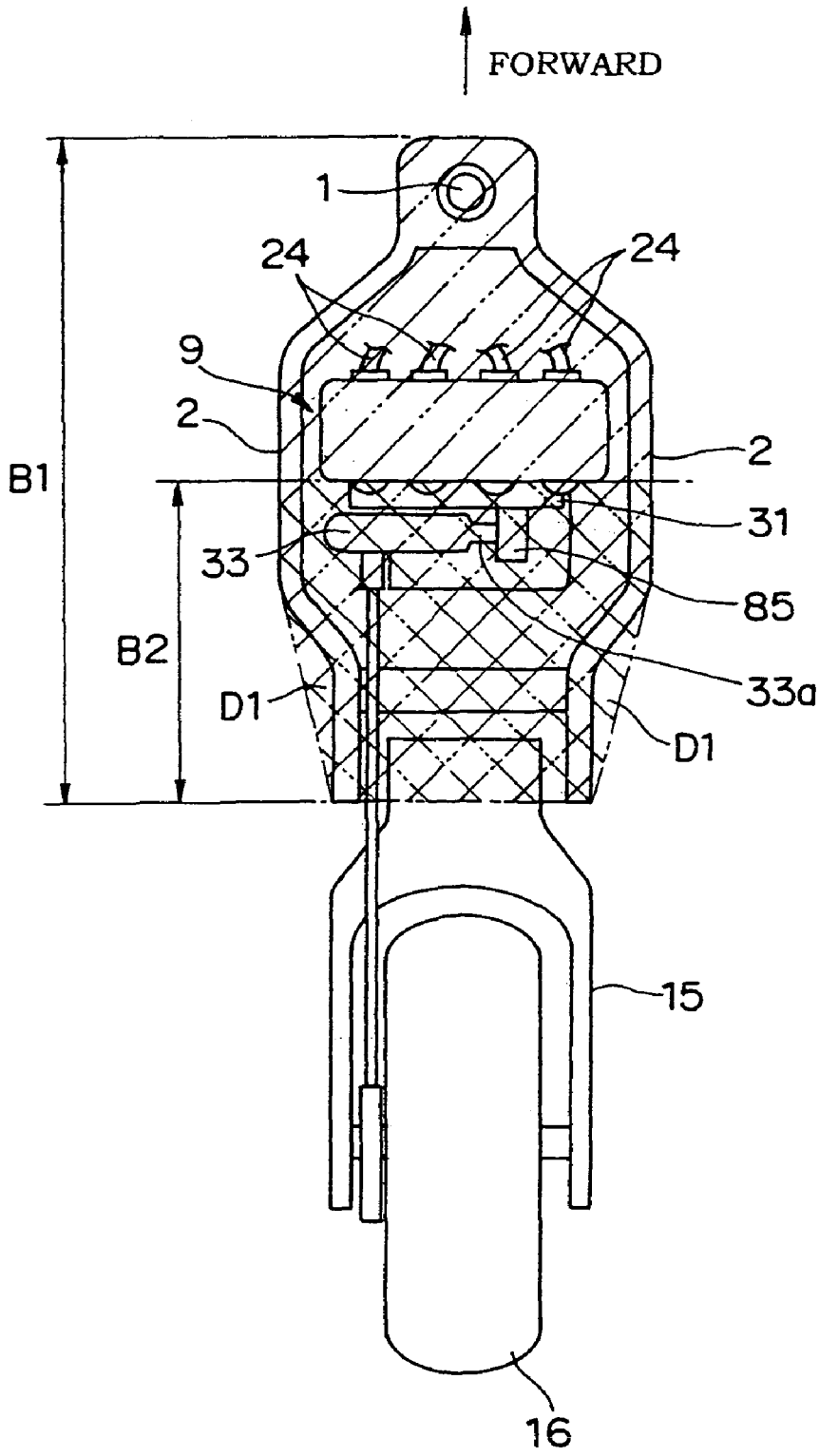
FIG. 2 is a plan view showing an arrangement relationship among a main frame, an internal combustion engine, a cylinder, and a rear wheel in the motorcycle of the first embodiment.

FIG. 2 is a plan view clearly showing an arrangement of the main frame 2, the internal combustion engine 9, and the like in the motorcycle of the first embodiment. Referring to FIG. 2, the internal combustion engine 9 is substantially accommodated in a space surrounded by the right and left main frames 2 and 2 when viewed from above the motorcycle. A rear wheel 16 is supported by a rear end portion of the swing arm 15 extended backward from the swing arm bracket 3 (FIG. 1).

(Valve and Valve-Operating Mechanism for Valve)

Figure 3:
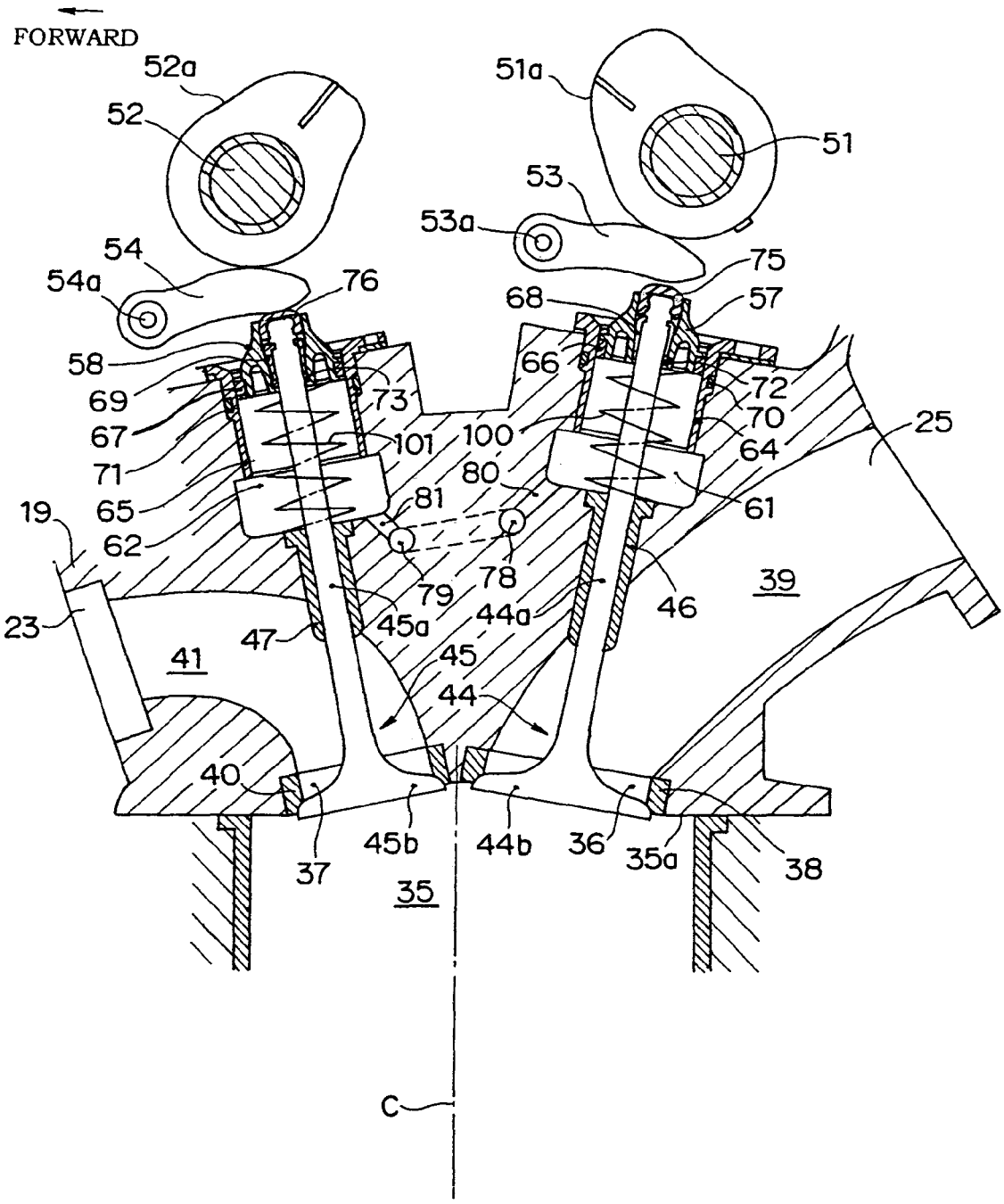
FIG. 3 is a longitudinal sectional view showing a valve portion of an internal combustion engine of the motorcycle of the first embodiment.
Figure 4:
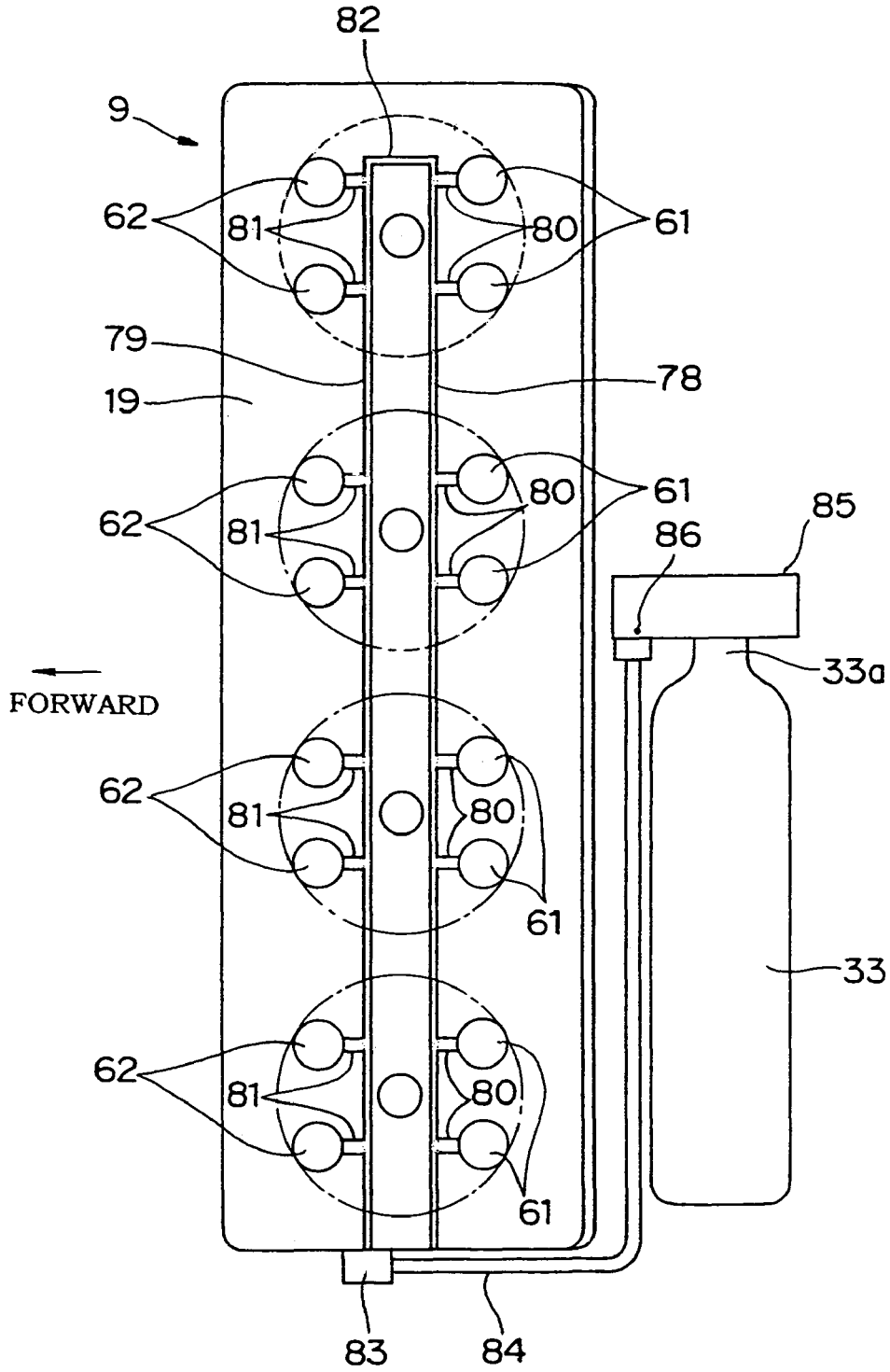
FIG. 4 is a horizontal sectional view showing a cylinder head of the internal combustion engine of the motorcycle of the first embodiment.

FIG. 3 is a longitudinal sectional view showing a valve portion of the internal combustion engine 9 of the motorcycle of the first embodiment, and FIG. 4 is a horizontal sectional view showing the cylinder head 19 of the internal combustion engine 9. Referring to FIG. 3, in a lower end face of the cylinder head 19 which constitutes a ceiling wall surface 35*a* of a combustion chamber 35 of each cylinder, a pair of right and left inlet ports 36 is formed at the back of a cylinder center line C, and a pair of right and left exhaust ports 37 is formed in front of the cylinder center line C. The inlet port 36 includes an inlet valve seat 38, and the inlet port 36 is communicated with the inlet opening 25 in the cylinder-head rear end face through an inlet passage 39 of the cylinder head 19. The exhaust port 37 includes an exhaust valve seat 40, and the exhaust port 37 is communicated with the exhaust slot 23 in the cylinder-head front end face through an exhaust passage 41 of the cylinder head 19.

Each cylinder includes a pair of right left inlet valves 44 and a pair of right and left exhaust valves 45 in order to open and close the combustion chamber 35 of the internal combustion engine 9. In cylindrical valve guides 46 and 47 rigidly bonded to the cylinder head 19, valve stems 44*a* and 45*a* of the inlet and exhaust valves 44 and 45 are supported while being slidable in a lengthwise direction of the valve stem 44*a* and 45*a* respectively. Valve head portions 44*b* and 45*b* formed at lower ends of the valve stem 44*a* and 45*a* face the valve seats 38 and 40 while being able to be seated from below.

The valve-operating mechanism which opens and closes the inlet and exhaust valves 44 and 45 at predetermined timing includes a drive means for driving the inlet and exhaust valves 44 and 45 in a valve opening direction and a biasing means for biasing the inlet and exhaust valves 44 and 45 in a valve closing direction. The drive means includes inlet-valve and exhaust-valve cam shafts 51 and 52 which are disposed in substantially parallel to a crankshaft and inlet-valve and exhaust-valve rocker arms 53 and 54 having swing shapes. The biasing means for biasing the inlet and exhaust valves 44 and 45 toward the valve closing direction includes inlet-valve and exhaust-valve gas spring chambers 61 and 62 in which pistons 57 and 58 are mounted therein.

The biasing means and drive means of the inlet-valve valve-operating mechanism will be described in detail. The cylindrical inlet-valve gas spring chamber 61 is formed above the inlet-valve guide 46 in the cylinder head 19, a cylindrical liner 64 is fitted in an inner circumferential surface of an upper half portion of the cylindrical inlet-valve gas spring chamber 61. An inlet-valve piston 57 is fitted in an inner circumferential surface of the liner 64 through a ring seal 66 and is slidable in an axis direction of the inlet valve stem 44*a*. The inlet valve stem 44*a* is projected from below toward the inlet-valve gas spring chamber 61. An upper end portion of the inlet valve stem 44*a* is fitted in the inlet-valve piston 57 with a cotter 68 interposed therebetween, and the inlet-valve piston 57 is movable in the axis direction of the inlet valve stem 44*a* while being integral with the inlet valve 44. In order to prevent the leakage of the gas from the inlet-valve gas spring chamber 61, a seal 70 is fitted between the outer circumferential surface of the liner 64 and the inner circumferential surface of the inlet-valve gas spring chamber 61 and seal 72 is fitted between the outer circumferential surface of the inlet valve stem 44*a* and the inner circumferential surface of the inlet-valve piston 57. That is, in the biasing means of the inlet-valve valve-operating mechanism, the inlet-valve piston 57 and the inlet valve 44 are biased toward the valve closing direction by filling the inlet-valve gas spring chamber 61 with the gas having a predetermined pressure, the valve head portion 44*b* of the inlet valve 44 is seated on the inlet valve seat 38 to close the inlet port 36.

The inlet-valve cam shaft 51 is disposed substantially above the inlet valve stem 44*a*, and the inlet-valve rocker arm 53 is disposed between the inlet-valve cam shaft 51 and the inlet valve stem 44*a*. An upper end of the inlet valve stem 44*a* is fitted in an end cap 75, and an upper end face of the end cap 75 abuts on a lower surface onto a free-end portion side of the inlet-valve rocker arm 53. An upper surface of the inlet-valve rocker arm 53 abuts on the cam portion 51*a* of the inlet-valve cam shaft 51 at a position located on a side of a rocker arm support shaft 53*a* of the position where the end cap 75 abuts on the inlet-valve rocker arm 53. That is, in the drive means of the inlet-valve valve-operating mechanism, the inlet-valve rocker arm 53, the piston 57, and the inlet valve 44 are integrally pushed down at predetermined valve opening timing by the rotation of the inlet-valve cam shaft 51, thereby opening the inlet port 36 against the compressed gas in the gas spring chamber 61.

Because the biasing means and drive means of the exhaust-valve valve-operating mechanism have the same structure as the inlet-valve valve-operating mechanism, the detailed description is omitted. The biasing means and drive means of the exhaust-valve valve-operating mechanism includes an exhaust-valve inlet-valve liner 65, a ring seal 67, a cotter 69, seals 71 and 73, and an end cap 76 which correspond to the inlet-valve liner 64, the ring seal 66, the cotter 68, the seals 70 and 72, and the end cap 75.

In the inlet and exhaust valve gas spring chambers 61 and 62, weak coil springs 100 and 101 which are of second biasing means for emergency use are provided between the piston 57 and 58 and the bottom walls of the gas spring chambers 61 and 62 respectively. Spring strength of each of the coil springs 100 and 101 is set to an extent in which the inlet and exhaust valves 44 and 45 are sufficiently seated during idling or low-speed rotation, and the spring strength is set to a value smaller than that of the biasing force generated by the gas in the gas spring chambers 61 and 62 which are of first biasing means.

Referring to FIG. 4, in the cylinder head 19, an inlet-valve gas passage 78 and an exhaust-valve gas passage 79 are formed in substantially parallel with the crankshaft in order to supply the compressible gas to the gas spring chambers 61 and 62. The inlet-valve gas passage 78 is communicated with the inlet-valve gas spring chamber 61 of each cylinder through an inlet valve gas branch passage 80, and the exhaust-valve gas passage 79 is communicated with the exhaust-valve gas spring chamber 62 of each cylinder through an exhaust-valve gas branch passage 81. Right end portions of the gas passages 78 and 79 are communicated with each other by a communication passage 82, a left end portion of the inlet-valve gas passage 78 is closed, and a left end portion of the exhaust-valve gas passage 79 is connected to a gas supply pipe 84 with a pipe joint 83 interposed therebetween. The gas supply pipe 84 is extended backward along the left side face of the cylinder head 19, and is bent rightward at the back of the cylinder head 19. Then, the gas supply pipe 84 is extended rightward at the back of the cylinder head 19, and is connected to a compressed gas outlet 86 of a pressure regulating valve 85 attached to the neck portion 33*a* of the compressed-gas container 33.

(Arrangement and Detailed Structure of Cylinder)

Figure 5:
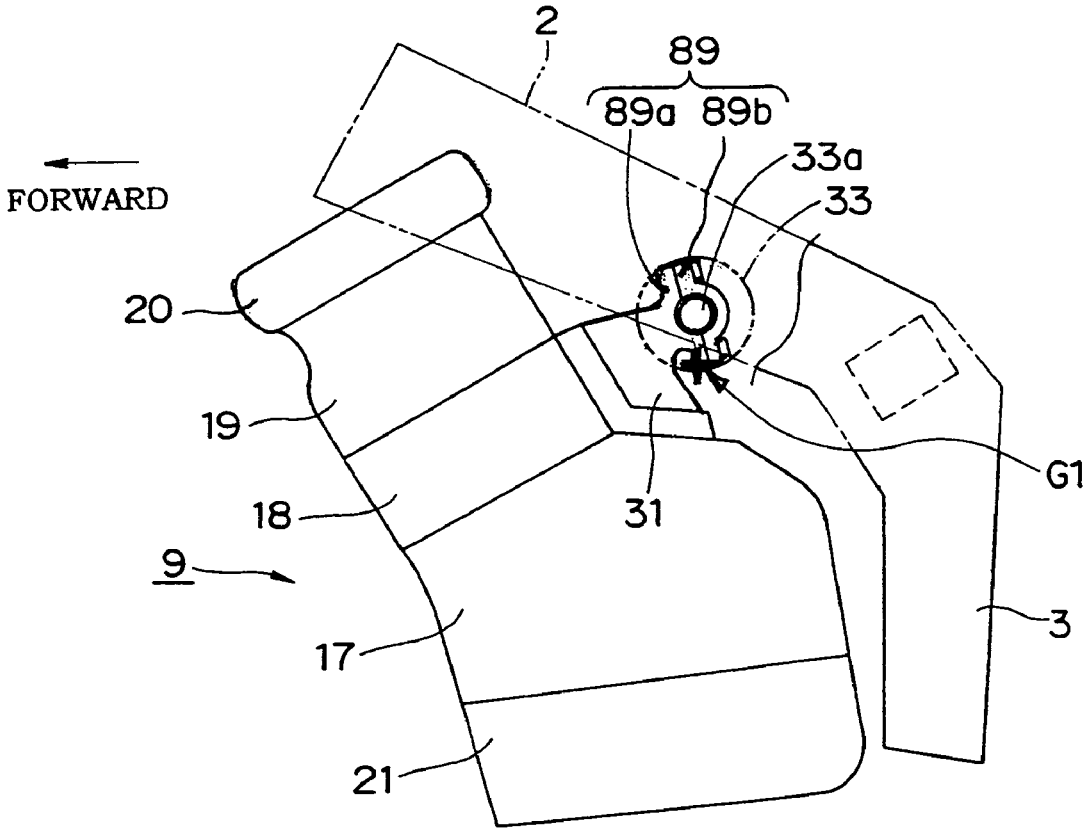
FIG. 5 is a left side view showing an arrangement relationship among the main frame, the internal combustion engine, and the cylinder in the motorcycle of the first embodiment.
Figure 6:
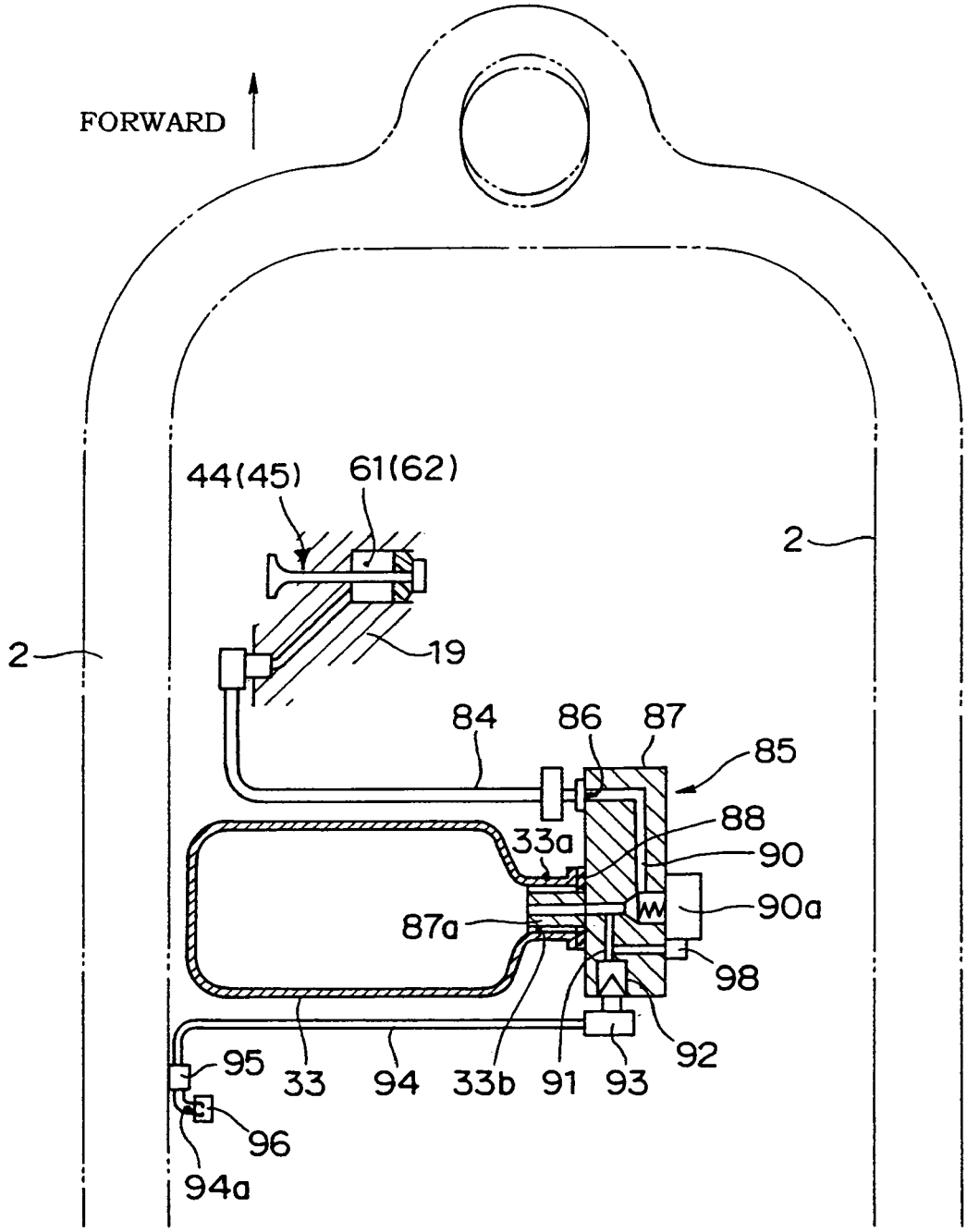
FIG. 6 is a horizontal sectional view showing the detailed cylinder of the first embodiment.

FIG. 5 is a left side view showing the internal combustion engine, and shows a detailed attaching state of the compressed-gas container 33. FIG. 6 is an enlarged horizontal sectional view showing the compressed-gas container 33. An arrangement and an attaching structure of the compressed-gas container 33 will be described with reference to FIGS. 2, 5, and 6. Referring to FIG. 2, the compressed-gas container 33 located at the back of the breather box 31 is disposed along the body width direction (right and left direction) with the neck portion 33*a* orientated rightward, and the pressure regulating valve 85 is attached to the neck portion 33*a* in the right end portion of the compressed-gas container 33. The compressed-gas container 33 is disposed within the outermost line of the body component, that is, the body frame when the motorcycle is viewed from above. In the first embodiment, when the motorcycle is viewed from above, the compressed-gas container 33 is disposed at the back of the breather box 31 such that the compressed-gas container 33 is completely accommodated in a right and left width of inner surfaces of the lateral main frames 2 and 2 and such that the compressed-gas container 33 is accommodated in a right and left width of the internal combustion engine 9. Similarly to the compressed-gas container 33, the pressure regulating valve 85 is disposed within the outermost line of the body frame when the motorcycle is viewed from above. In the first embodiment, when the motorcycle is viewed from above, the pressure regulating valve 85 is disposed at the back of the breather box 31 such that the pressure regulating valve 85 is completely accommodated in a right and left width of inner surfaces of the lateral main frames 2 and 2 and such that the pressure regulating valve 85 is accommodated in a right and left width of the internal combustion engine 9. The pipe 84 is also disposed within the outermost line of the body frame.

Referring to FIG. 5, the compressed-gas container 33 is attached to a compressed-gas container attaching portion 89 at the back of the breather box 31. The compressed-gas container attaching portion 89 includes a pair of half members 89*a* and 89*b* having semi-circular recesses, the half member 89*a* is integral with the breather box 31 made of a resin (or an aluminum alloy), and the half member 89*b* is fixed to the half members 89*a* by a bolt. The neck portion 33*a* of the compressed-gas container 33 is grasped by the semi-circular recesses of the half members 89*a* and 89*b*.

When the motorcycle is laterally viewed, the compressed-gas container 33 is disposed such that almost the pressure regulating valve 85 overlaps the main frame 2, whereby the right and left end portions of the compressed-gas container 33 is substantially covered with the lateral main frames 2 and 2. When the motorcycle is laterally viewed, the compressed-gas container 33 is disposed at a position including a gravitational center G1 of the motorcycle body or near the position.

Then, structures of the compressed-gas container 33 and pressure regulating valve 85 will be described with reference to FIG. 6. An internal thread 33*b* is formed in an inner surface of the neck portion 33*a* of the compressed-gas container 33, and an external thread 87*a* formed in the valve body 87 of the regulating valve 85 is screwed on the internal thread 33*b* of the neck portion 33*a*. A seal 88 is disposed between an open end of the neck portion 33*a* and the valve body 87 to maintain the inside of the compressed-gas container 33 in an air-tight state.

A gas passage 90 from the compressed-gas container 33 to the gas outlet 86 is formed in the valve body 87, and a pressure regulating mechanism 90*a* is provided in the middle of the gas passage 90. The compressed gas in the compressed-gas container 33 is reduced to a predetermined pressure by the pressure regulating mechanism 90*a*, and the compressed gas having the predetermined pressure is supplied to the gas spring chambers 61 and 62 through the gas supply pipe 84.

An injection passage 91 is formed in the valve body 87 in order to inject the gas into the compressed-gas container 33, and a gas supply pipe 94 is connected to the injection passage 91 while a reed valve (one-way valve) 92 and a pipe joint 93 are interposed therebetween. The gas supply pipe 94 is extended leftward along the rear surface of the compressed-gas container 33 to the inner surface (right side face) of the left main frame 2, and is retained in the left main frame 2 by a clamp 95. The gas supply pipe 94 is folded back rightward into a U-shape. A distal end of the gas supply pipe 94 includes an injection port 94*a* which is opened to the right. A cap 96 is detachably attached to the injection port 94*a*. That is, the cap 96 is detached, and the injection port 94 is connected to an external air compressor, whereby the gas is injected into the compressed-gas container 33 through the gas supply pipe 94, the reed valve 92, and the injection passage 91. A relief valve 98 is provided in the injection passage 91 in the valve body 87, thereby preventing the excessive gas injection into the compressed-gas container 33.

(Operation)

Referring to FIG. 6, the gas such as air is periodically injected into the compressed-gas container 33 through the injection port 94*a* or the gas is injected if needed. The gas in the compressed-gas container 33 is reduced to the predetermined pressure by the pressure regulating mechanism 90*a* of the pressure regulating valve 85, and the gas spring chambers 61 and 62 are filled with the gas.

Referring to FIG. 3, during the running of the internal combustion engine, the inlet and exhaust valves 44 and 45 are biased toward the valve closing direction with the pistons 57 and 58 interposed therebetween by the pressures of the compressed gases in the gas spring chambers 61 and 62, thereby closing the inlet and exhaust ports 36 and 37. The rotations of the cam shafts 51 and 52 push down the pistons 57 and 58 and inlet and exhaust valves 44 and 45 with the rocker arms 53 and 54 interposed therebetween at predetermined valve opening timing, thereby opening the inlet and exhaust ports 36 and 37. In opening the valve, the gases in the gas spring chambers 61 and 62 are compressed. When driving forces (downward pushing action) generated by the cam shafts 51 and 52 are removed, the inlet and exhaust valves 44 and 45 are returned to the valve closed state by the pressures of the gases compressed in the gas spring chambers 61 and 62.

Even if the gas pressure in the compressed-gas container 33 is lowered below the predetermined pressure for any reason, because the coil springs 100 and 101 are provided as the second biasing means, the opening and closing actuation of the inlet and exhaust valves 44 and 45 can be maintained at least during the low-speed rotation.

(1) In the first embodiment, the gas spring type valve-operating mechanism is provided. Therefore, the capability of following the opening and closing timing of the inlet and exhaust valves 44 and 45 becomes better than that of the coil spring type valve-operating mechanism, and the generation of the machine noise can be suppressed during the high-speed rotation.

(2) In the first embodiment, the compressed-gas container 33 filled with the gas is provided. Therefore, the need for providing the drive means is eliminated unlike the case where the gas compressor is provided, and the machine noise caused by the drive means is not generated.

(3) Because the metallic member constituting the outer shell does not exist in some of the motorcycles, sometimes rigidity of the compressed-gas container 33 is enhanced in consideration of a risk of the contact of the compressed-gas container 33 with the object outside the body. On the other hand, in the first embodiment, the compressed-gas container 33 is disposed in the body component. Therefore, the need for excessively enhancing the rigidity of the compressed-gas container 33 is eliminated, and the weight reduction and the cost reduction can be achieved in the motorcycle. That is, the compressed-gas container 33 is disposed between the right and left main frames 2 and 2 when the motorcycle is viewed from above, and the compressed-gas container 33 is disposed at the position where the compressed-gas container 33 overlaps the main frame 2 and 2 when the motorcycle is laterally viewed, so that the contact of the compressed-gas container 33 with the object outside the body can be prevented by the main frames 2 and 2 and the need for excessively enhancing the rigidity of the compressed-gas container 33 can be eliminated to achieve the weight reduction and the production cost reduction.

(4) The compressed-gas container 33 is disposed on the opposite side (rear side) to the side (front side) of the exhaust opening 23 of the cylinder head 19, so that the exhaust heat of the exhaust opening 23 or exhaust pipe 24 can be prevented from transferring to the compressed-gas container 33.

(5) The compressed-gas container 33 is provided near the gravitational center G1 of the body when the motorcycle is laterally viewed. Therefore, the attachment of the compressed-gas container 33 has no influence on the position of the gravitational center of the body, and the drivability of the motorcycle can be maintained.

(6) The pressure regulating valve 85 which regulates the gas pressures of the gas spring chambers 61 and 62 are attached to the compressed-gas container 33. Therefore, the gas pressures in the gas spring chambers 61 and 62 can be maintained at the optimum values for opening and closing the inlet and exhaust valves 44 and 45, the pressure regulating valve 85 can compactly be disposed along with the compressed-gas container 33, and the pressure regulating valve 85 can easily be attached to and detached from the body along with the compressed-gas container 33.

(7) In addition to the biasing means of the compressible gas, the coil spring 100 and 101 which bias the inlet and exhaust valves 44 and 45 toward the valve closing direction are disposed in the gas spring chambers 61 and 62. Therefore, even if the gas pressure in the compressed-gas container 33 is lowered, the actuation of the inlet and exhaust valves 44 and 45 can be maintained by the coil springs 100 and 101 without stopping the internal combustion engine 9.

(8) The compressed-gas container 33 is attached to the breather box 31 formed by resin molding or aluminum forming independently of the crankcase 17 and the cylinder block 18, so that internal combustion engine vibration transmitted from the internal combustion engine 9 to the compressed-gas container 33 can be suppressed.

(9) In the first embodiment, the compressed-gas container 33 is also disposed in a region defined as follows. The compressed-gas container 33 is disposed such that the compressed-gas container projection region is located inside the outer-shell projection region in the body width direction. The compressed-gas container projection region indicates the outer shape of the compressed-gas container projected to a virtual plane perpendicular in a body fore-and-aft direction. The outer-shell projection region is obtained by projecting one or more body component except for the compressed-gas container 33 to the virtual plane. In such cases, preferably the compressed-gas container projection region is disposed not only in the inside of the body component in the right and left direction, but also in the inside of the body component in the vertical direction. Specifically, as is clear from FIGS. 1 and 2, when the body is viewed from the front side, the compressed-gas container 33 is disposed such that the whole of the compressed-gas container 33 is hidden behind the internal combustion engine 9.

(10) In the first embodiment, the compressed-gas container 33 is covered in the vertical direction with the body components such as the air cleaner box 10 and the crankcase 17 except for the compressed-gas container, and the compressed-gas container 33 is also covered in the fore-and aft direction with the body components such as the cylinder block 18, the cylinder head 19, the body-frame cross member 5 except for the compressed-gas container, so that the contact with the object outside the body can be prevented in the fore-and aft direction and in the vertical direction. The compressed-gas container projection region may enter the inside of the outer-shell projection region formed by the plural body components.

(11) In the first embodiment, the compressed-gas container 33 is disposed at the back of the body component, namely, the compressed-gas container 33 is disposed at the back of the internal combustion engine 9, so that the object outside the body which is moved from the front to the rear of the body during the driving can be prevented from contacting the compressed-gas container.

(12) The compressed-gas container 33 has the structure in which one side portion of the compressed-gas container 33 in the body width direction, preferably both side portions in the body width direction is covered with the body component except for the compressed-gas container.

(13) In the first embodiment, as shown in FIG. 2, the main frame 2 is extended backward while branched from the head pipe 1, and the compressed-gas container 33 is disposed between the right and left portions of the main frame 2, so that the contact of the object outside the body with the compressed-gas container 33 can further effectively be prevented.

(14) In the first embodiment, the compressed-gas container 33 is formed into a cylindrical shape having a bottom wall, in which an opening is formed in one end portion in the axial line direction of the compressed-gas container 33. In the compressed-gas container 33, one end portion in the axial line direction in which the opening is formed is located closer to the center of the body width direction rather than the other end portion in the axial line direction, and a space is formed around one end portion in the axial line direction. Therefore, an effect of protecting the opening of the compressed-gas container 33 can be enhanced, and the opening of the compressed-gas container 33 can be prevented from contacting the body frame even if the vibration is generated. Even if the other end portion in the axial line direction in which the bottom wall is formed contacts the frame, the compressed-gas container 33 is hardly damaged.

(15) In the first embodiment, the outer shape of the compressed-gas container 33 is formed into the substantially rod shape, and the compressed-gas container 33 is disposed such that the axial line of the compressed-gas container 33 is extended in the body width direction. Therefore, the sizes in the fore-and-aft direction and vertical direction can be decreased in the compressed-gas container accommodation region, and therefore a degree of freedom of the body design can be enhanced to realize the space saving.

(16) In the first embodiment, as shown in FIG. 6, the injection port 94*a* of the gas supply pipe 94, which is used to inject the gas into the compressed-gas container 33, is disposed on the body outward side of the neck portion 33*a* located on the opening of the compressed-gas container 33. Therefore, the injection work of the gas through the injection port 94*a* can easily performed compared with the injection work of the gas from the side of the neck portion 33*a* of the compressed-gas container 33.

Second Embodiment

Figure 7:
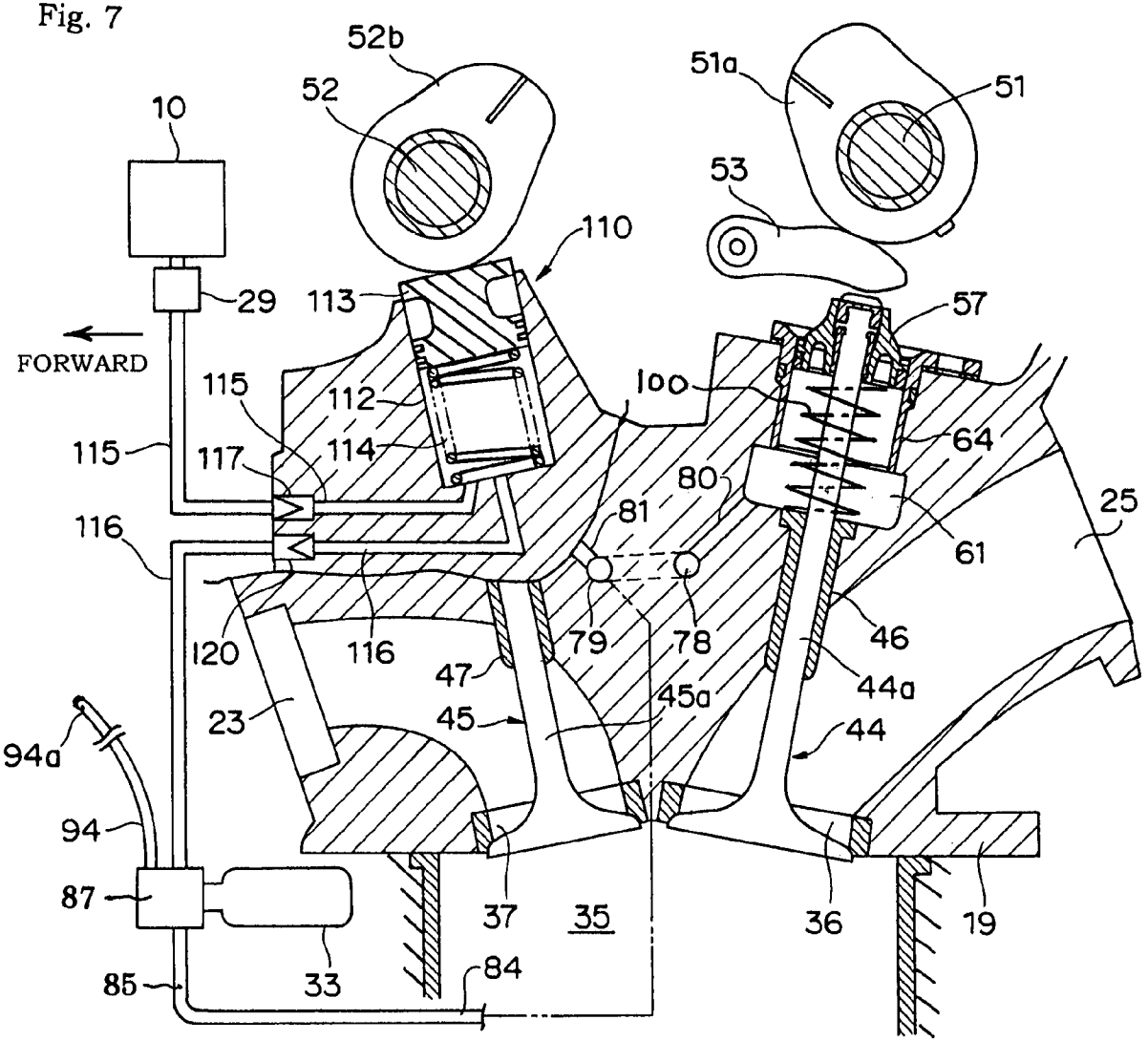
FIG. 7 shows a motorcycle provided with a valve-operating mechanism according to a second embodiment of the invention.

FIG. 7 shows a motorcycle provided with a valve-operating mechanism according to a second embodiment of the invention, and is a longitudinal sectional view showing a valve portion of the internal combustion engine of the second embodiment. In FIG. 7, the gas piping is simplified. In addition to the structure of the first embodiment shown in FIGS. 1 to 6, the valve-operating mechanism of the second embodiment has a structure in which a gas compressor 110 driven by the exhaust-valve cam shaft 52 is included as a gas feeder and the gas (air) compressed by the gas compressor 110 during the running of the internal combustion engine is supplied to the compressed-gas container 33. Other structures are similar to those of the first embodiment, and the same component or part as the first embodiment is designated by the same numeral.

Referring to FIG. 7, the gas compressor 110 includes a cylinder portion 112, a piston portion 113, and a coil spring 114. The cylinder portion 112 is formed in the cylinder head 19 below the exhaust-valve cam shaft 52. The piston portion 113 is slidably fitted in the cylinder portion 112 with a seal interposed therebetween. The coil spring 114 biases the piston portion 113 toward the side of the exhaust-valve cam shaft 52. An upper surface of the piston portion 113 abuts on a compressor driving cam portion 52*b* formed in the exhaust-valve cam shaft 52.

A suction passage 115 and a discharge passage 116 are communicated with the cylinder portion 112, and the suction passage 115 is communicated with the air cleaner 29 and the air cleaner case 10 through a one-way valve 117. The one-way valve 117 is configured to supply the gas only from the air cleaner 29 to the cylinder portion 112. The discharge passage 116 is communicated with the compressed-gas container 33 through a one-way valve 120, a passage in the valve body 87 of the pressure regulating valve 85, and a relief valve. The one-way valve 120 is configured to supply the gas only from the cylinder portion 112 to the compressed-gas container 33.

In the second embodiment, a working pressure of the relief valve is set larger than a working pressure of the pressure regulating valve 85. The working pressure of the pressure regulating valve 85 has a value enough to impart the biasing force to the inlet and exhaust valves 44 and 45. The working pressure of the relief valve is set to a maximum allowable withstanding pressure of the compressed-gas container.

When the exhaust-valve cam shaft 52 is rotated during the running of the internal combustion engine, the piston portion 113 is reciprocally slid by the cooperation between the compressor driving cam portion 52*b* and the coil spring 114. Therefore, the gas is sucked from the air cleaner 29 through the suction passage 115 and the one-way valve 117, the gas is compressed in the cylinder portion 11, and the compressed air is supplied to the compressed-air cylinder 33 through the discharge passage 116 and the one-way valve 120.

In the second embodiment, because the compressed-gas container 33 is always filled with the gas during the running of the internal combustion engine, the need for manually injecting the gas into the compressed-gas container 33 is eliminated to facilitate the maintenance of the valve-operating mechanism.

The existing exhaust-valve cam shaft 52 is used as the drive source of the gas compressor 110, so that the number of components can be decreased.

The compressed-gas container 33 also acts as an accumulator of the gas from the gas compressor 110.

In the second embodiment, the inlet-valve cam shaft 51 can be used as the drive source of the gas compressor 110 instead of the exhaust-valve cam shaft 52, and the rotary member rotated by the crankshaft of the internal combustion engine can be used as the drive source of the gas compressor 110.

In the second embodiment, because the compressed-gas container 33 functions as the accumulator, even if the internal combustion engine 9 is not driven for a long time, the compressed gas is accumulated in the compressed-gas container 33, thereby preventing a lack of the spring force.

Third Embodiment

Figure 8:
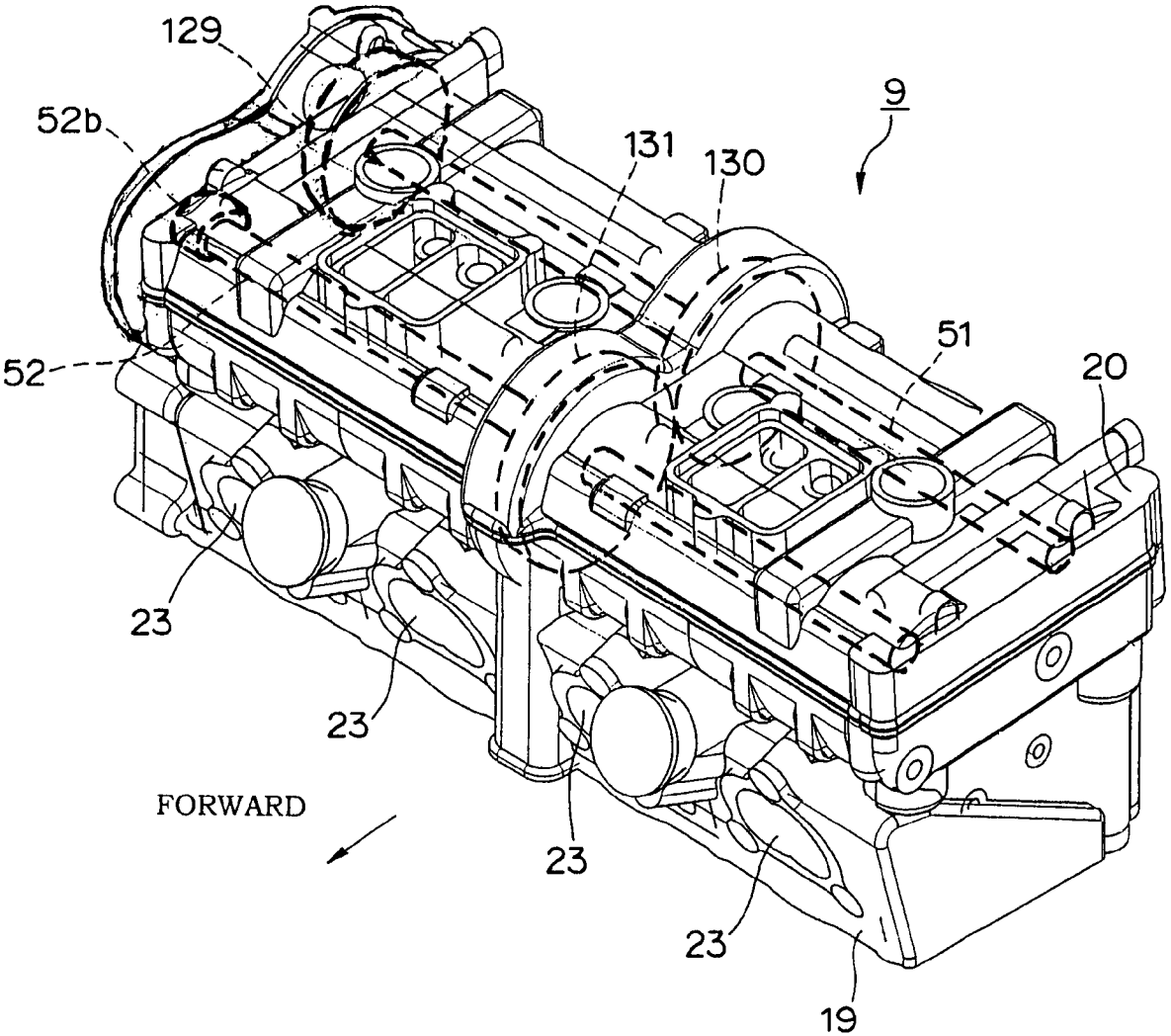
FIG. 8 shows a motorcycle provided with a valve-operating mechanism according to a third embodiment of the invention.
Figure 9:
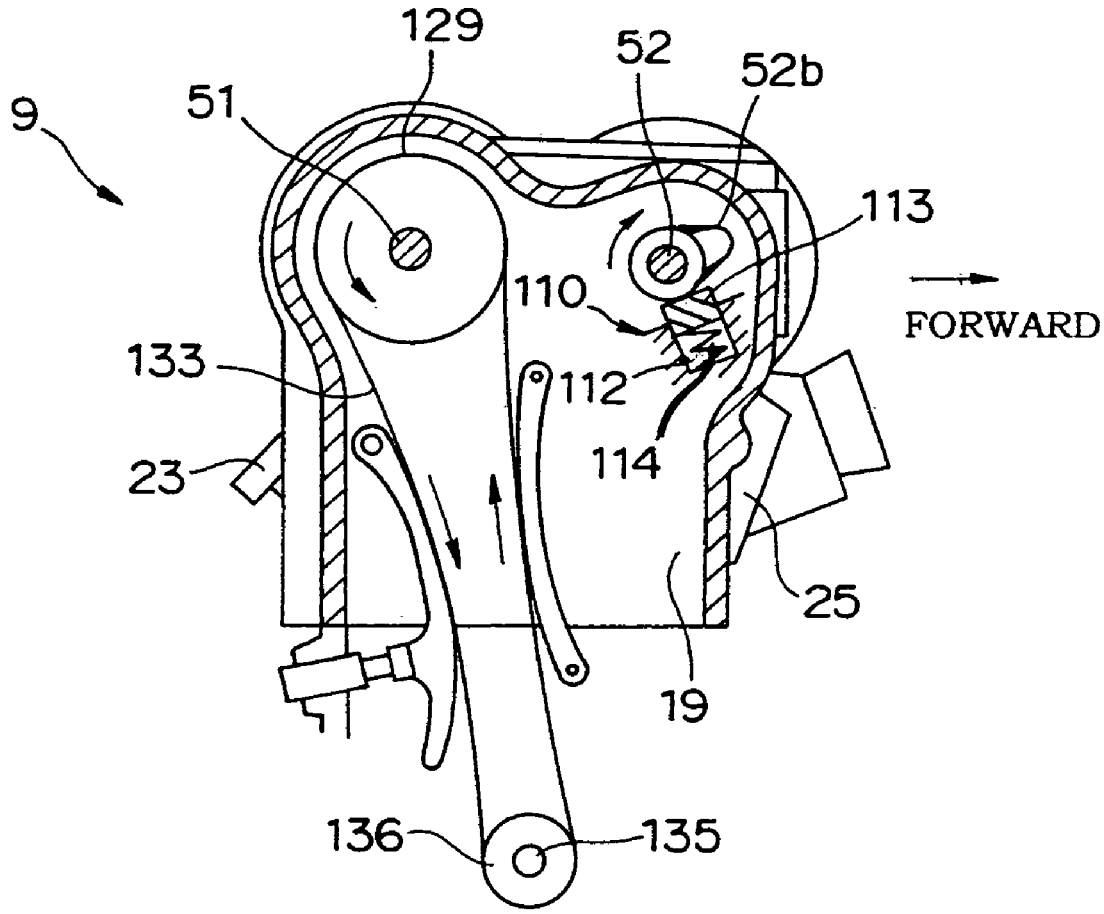
FIG. 9 is a longitudinal sectional view showing an end portion of the internal combustion engine of FIG. 8 when the internal combustion engine is viewed in a crankshaft direction.

FIGS. 8 and 9 show a motorcycle provided with a valve-operating mechanism according to a third embodiment of the invention. The valve-operating mechanism of the third embodiment has a structure in which the disposition of the compressor driving cam portion 52*b* is devised in the motorcycle provided with the gas compressor 110 in which the exhaust-valve cam shaft 52 is used as the drive source like the second embodiment. The same component or part as the first and second embodiments is designated by the same numeral.

FIG. 8 is a perspective view showing the internal combustion engine 9 of the third embodiment. The compressor driving cam portion 52*b* provided in the exhaust-valve cam shaft 52 is disposed in an end portion on the side where a cam chain is disposed, that is, in a right end portion of the internal combustion engine 9. A cam chain sprocket 129 is provided in a right end portion of the inlet-valve cam shaft 51, and the inlet-valve cam shaft 51 and the exhaust-valve cam shaft 52 are coupled at a substantial central portion in a crankshaft direction by a pair of transmission gears 130 and 131 while power can be transmitted. Therefore, the rotation of the inlet-valve cam shaft 51 is transmitted to the exhaust-valve cam shaft 52 through the gears 130 and 131.

FIG. 9 is an enlarged longitudinal sectional view showing a right end portion of the inlet-valve and exhaust-valve cam shafts 51 and 52. A cam chain 133 is entrained about the chain sprocket 129 of the inlet-valve cam shaft 51 and a chain sprocket 136 of a crankshaft 135, and a torque of the crankshaft 135 is transmitted to the inlet-valve cam shaft 51. On the other hand, instead of the chain sprocket, the compressor driving cam portion 52*b* is provided in the right end portion of the exhaust valve cam shaft 52. Similar to the gas compressor 110 of FIG. 7, the gas compressor 110 including the cylinder portion 112, the piston portion 113, and the coil spring 114 is provided below the compressor driving cam portion 52*b*, and the upper surface of the piston portion 113 abuts on the compressor driving cam portion 52*b*.

Because the working of the third embodiment is similar to that of the second embodiment, the description is omitted.

In the third embodiment, the chain sprocket of the exhaust-valve cam shaft 52 is removed, and the gas compressor 110 and the compressor driving cam portion 52*b* are disposed in the right end portion and the surroundings of the exhaust-valve cam shaft 52. Therefore, the space saving can be achieved in the internal combustion engine.

Fourth Embodiment

Figure 10:
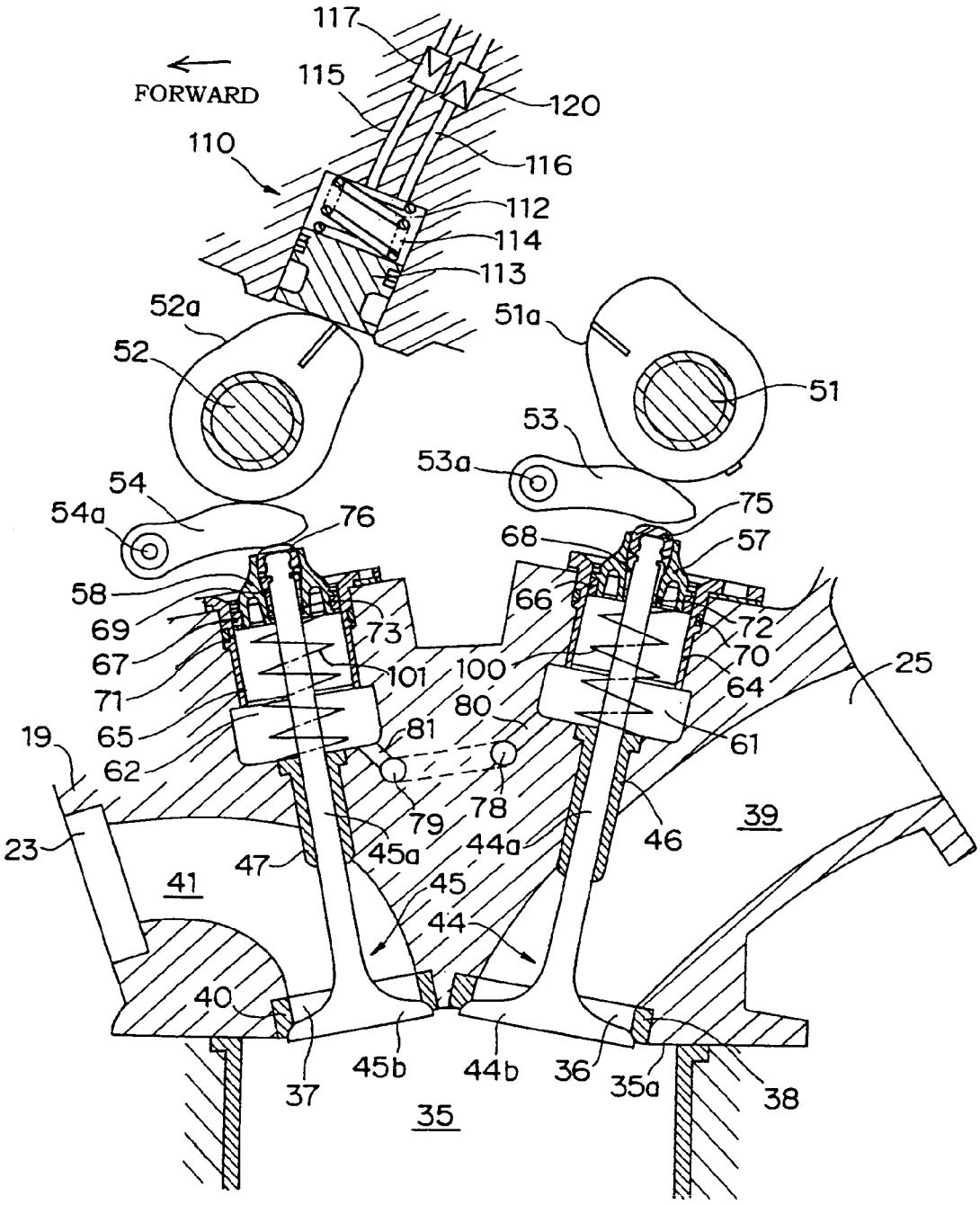
FIG. 10 shows a motorcycle provided with a valve-operating mechanism according to a fourth embodiment of the invention.

FIG. 10 shows a motorcycle provided with a valve-operating mechanism according to a fourth embodiment of the invention. The valve-operating mechanism of the fourth embodiment has a structure in which the disposition of the exhaust-valve driving cam portion 52*b* is also utilized as the compressor driving cam portion in the motorcycle provided with the gas compressor 110 in which the exhaust-valve cam shaft 52 is used as the drive source like the second embodiment. The same component or part as the first and second embodiments is designated by the same numeral.

Referring to FIG. 10, the gas compressor 110 including the cylinder portion 112, the piston portion 113, and the coil spring 114 is disposed above an existing exhaust-valve cam portion 52*a* of the exhaust-valve cam shaft 52, the lower surface of the piston portion 113 abuts on the exhaust-valve cam portion 52*a*, and the exhaust valve 45 and the gas compressor 110 are driven by the one cam portion 52*a*.

In the fourth embodiment, the need for forming a new cam portion for driving the compressor can be eliminated to decrease the number of components. In the fourth embodiment, obviously the existing cam portion 51*a* of the inlet-valve cam shaft 51 can be used as the drive source of the gas compressor 110.

Fifth Embodiment

Figure 11:
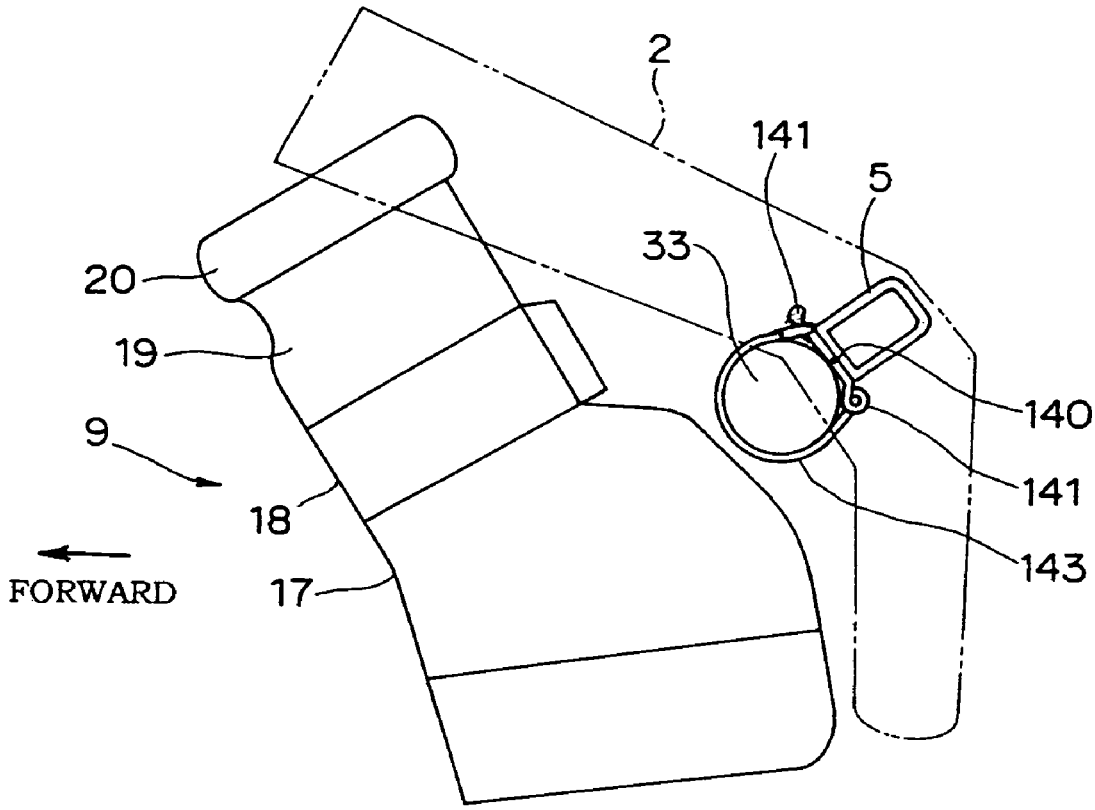
FIG. 11 shows a motorcycle provided with a valve-operating mechanism according to a fifth embodiment of the invention.

FIG. 11 shows a motorcycle provided with a valve-operating mechanism according to a fifth embodiment of the invention. The motorcycle provided with the valve-operating mechanism of the fifth embodiment has a structure in which the compressed-gas container 33 is attached to the cross member 5 of the main frame 2. Other structures are similar to those of the first embodiment, and the same component or part as the first embodiment is designated by the same numeral.

Referring to FIG. 11, a compressed-gas container attaching bracket 140 is provided in the front face of the cross member 5, hook portions 141 are formed in upper and lower end portions of the compressed-gas container attaching bracket 140, and end portions of a tightening rubber band 143 are engaged in the hook portions 141. That is, the compressed-gas container 33 is displaced in the front face of the compressed-gas container attaching bracket 141, and the compressed-gas container 33 is tightened by the rubber band 143.

In the fifth embodiment, the vibration of the internal combustion engine 9 is hardly transmitted to the compressed-gas container 33, and the need for detaching the compressed-gas container 33 is eliminated when the internal combustion engine 9 is attached to and detached from the body.

Sixth Embodiment

Figure 12:
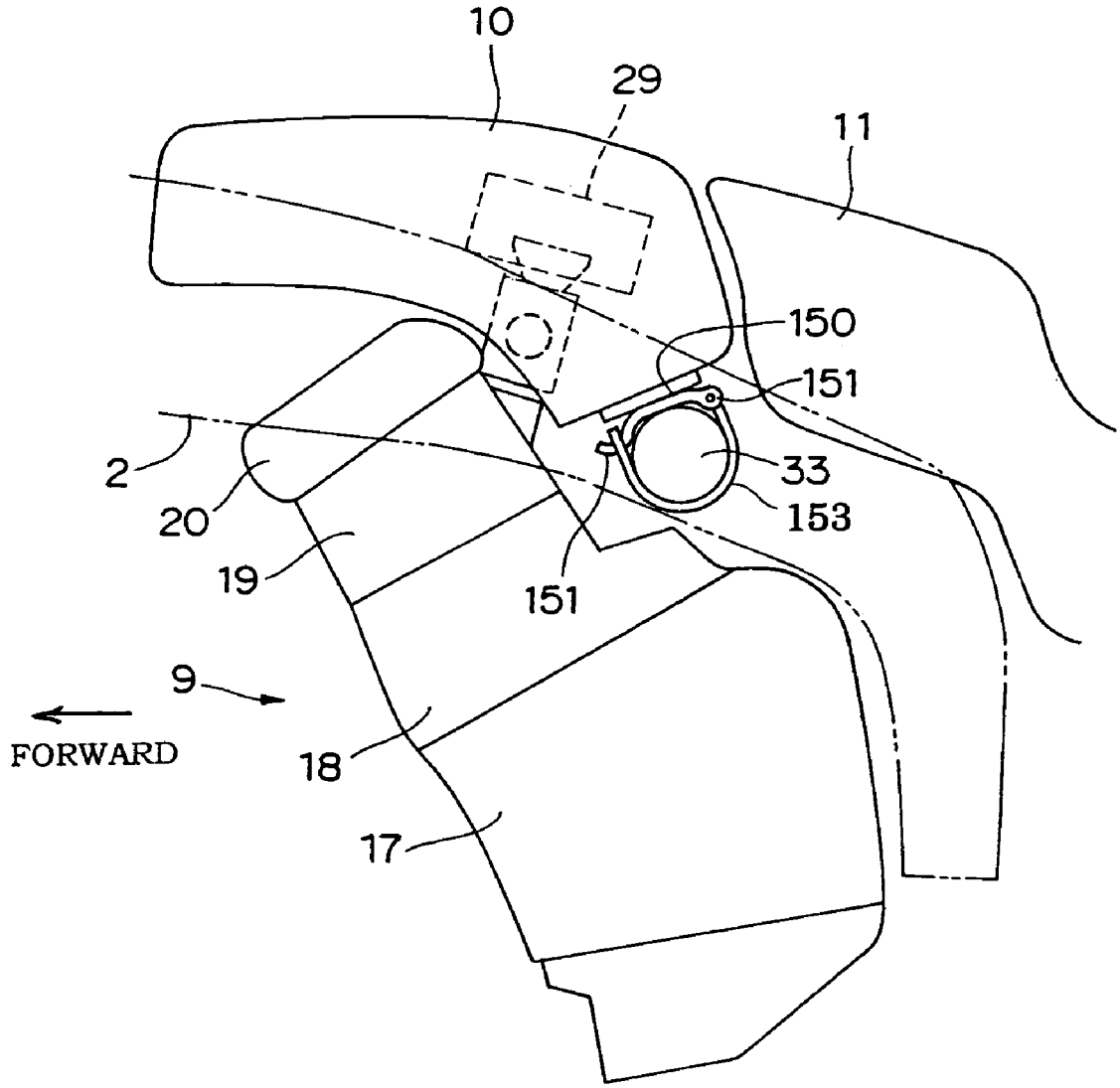
FIG. 12 shows a motorcycle provided with a valve-operating mechanism according to a sixth embodiment of the invention.

FIG. 12 shows a motorcycle provided with a valve-operating mechanism according to a sixth embodiment of the invention. The motorcycle provided with the valve-operating mechanism of the fifth embodiment has a structure in which the compressed-gas container 33 is attached to the air cleaner box 10. Other structures are similar to those of the first embodiment, and the same component or part as the first embodiment is designated by the same numeral.

Referring to FIG. 12, a compressed-gas container attaching bracket 160 is provided in a rear, lower end portion of the air cleaner box 10, a hook portion 151 is formed in front and rear end portions of the compressed-gas container attaching bracket 150, and end portions of a tightening rubber band 153 are engaged in the hook portions 151. That is, the compressed-gas container 33 is placed in the lower surface of the compressed-gas container attaching bracket 150, and the compressed-gas container 33 is tightened by the rubber band 153.

In the sixth embodiment, the vibration of the internal combustion engine 9 is hardly transmitted to the compressed-gas container 33, and the need for detaching the compressed-gas container 33 is eliminated when the internal combustion engine 9 is attached to and detached from the body.

Seventh Embodiment

Figure 13:
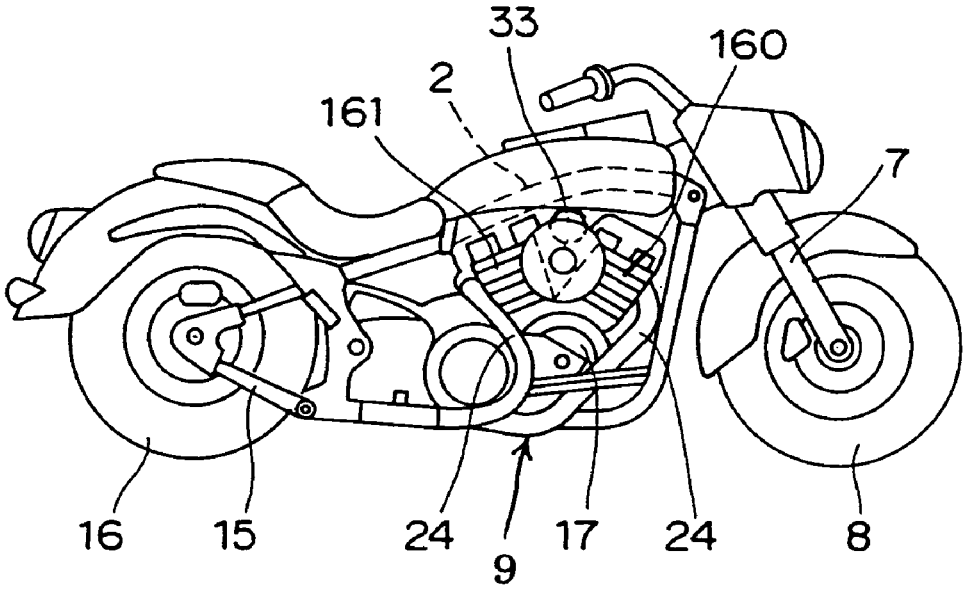
FIG. 13 shows a motorcycle provided with a valve-operating mechanism according to a seventh embodiment of the invention.

FIG. 13 shows a motorcycle provided with a valve-operating mechanism according to a seventh embodiment of the invention. The valve-operating mechanism of the seventh embodiment is applied to the motorcycle on which the V-type internal combustion engine 9 is mounted, and the compressed-gas container 33 for the valve-operating mechanism is mounted in a V-bank between a front cylinder 160 having a forward tilting attitude and a rear cylinder 161 having a backward tilting attitude. The valve-operating mechanism of the internal combustion engine 9 has a structure substantially similar to that of the first embodiment.

In the seventh embodiment, the compressed-gas container 33 can compactly be disposed by utilizing the V-bank of the V-type internal combustion engine, and the contact of the compressed-gas container 33 with the object outside the body can be protected by the front and rear cylinders 160 and 161.

Other Embodiments (1) In the first embodiment, the compressed-gas container 33 is substantially completely accommodated in the space surrounded by the right and left main frames 2 and 2 when the motorcycle is viewed from above. The invention is not limited to the disposition range of the first embodiment, but the present invention includes a structure in which the compressed-gas container 33 is disposed at least within the outermost line of the body component such as the main frame when the motorcycle is viewed from above. As used herein, the outermost line of the body component shall include a range surrounded by the right and left outer circumferential side faces of the main frames 2 and 2 in a range B1 in the fore-and-aft direction from the head pipe 1 to the swing arm bracket 3, for example, a region indicated by a hatched portion (also including a cross-hatched portion) in the case of the body provided with the pair of lateral main frames 2 and 2 of FIG. 2. As shown by symbols D1, even in the outsides of the main frames 2 and 2, a region within the line connecting the outwardly-projected portions is also included in the outermost line of the body component. Preferably, in the case where the multi-cylinder internal combustion engine 9 in which the plural cylinders are transversely arranged in parallel is mounted, the compressed-gas container 33 is disposed in the range at the back of the cylinder head 19 so as to be kept away from the exhaust pipe 24 like a region (B2 range) shown by the cross-hatching of FIG. 2.

(2) Preferably the body component which protects the compressed-gas container 33 is made of a metallic material. For example, in addition to the main frame 2 of the body frame, the body component which protects the compressed-gas container 33 can be the crankcase 17, the cylinder block 18, the internal combustion engine case, the transmission case 17*a*, the cross member 5, or the oil tank.

(3) Although the compressed-gas container 33 is transversely (horizontally) disposed in the first embodiment, the compressed-gas container 33 can longitudinally be disposed such that the neck portion 33*a* is orientated toward the upward or downward direction.

(4) In each of the above-described embodiments, the breather box 31, the cross member 5 of the main frame 2, and the air cleaner case 10 which are formed independently of the internal combustion engine 9 are used as the member to which the compressed-gas container 33 is attached. Alternatively, the compressed-gas container 33 can directly be attached to the main frames 2 and 2 or the internal combustion engine 9, and the compressed-gas container 33 can be attached to other members such as the fuel tank 11. In the case where the compressed-gas container 33 is attached to the main frame 2, the need for detaching the compressed-gas container 33 is eliminated when the internal combustion engine 9 or the gear box is detached. In the case where the compressed-gas container 33 is attached to the internal combustion engine 9, the gas piping from the compressed-gas container 33 to the gas spring passage of the internal combustion engine 9 can be most shortened.

(5) In FIG. 1 of the first embodiment, the compressed-gas container 33 is disposed at the position where the compressed-gas container 33 overlaps the main frame 2 when the motorcycle is viewed from above. The present invention also includes the structure in which the compressed-gas container 33 is disposed so as to be completely separated from the main frame 2 or other body components when the motorcycle is laterally viewed.

(6) In FIG. 1 of the first embodiment, the compressed-gas container 33 is disposed at the position including the gravitational center G1 of the body or the surroundings of the position. Alternatively, the compressed-gas container 33 can be disposed at the position including the gravitational center of the internal combustion engine 9 or the surroundings of the position. In the motorcycle, frequently the gravitational center G1 of the body and the gravitational center of the internal combustion engine are disposed close to each other.

(7) In the case where the gas compressor 110 which supplies the gas to the compressed-gas container 33 is provided, the valve driving cam shaft is used as the drive source in the second to fourth embodiments. Alternatively, a drive source such as an electric motor and a hydraulic motor can separately be provided.

(8) In the first embodiment, the right and left main frames 2 and 2 are included as the body component. Furthermore, the present invention can also be applied to the motorcycle having the structure the main frame is formed by one box-shape member having a large body width, that is, a monocoque frame. For the monocoque frame, when the motorcycle is laterally viewed, the compressed-gas container is disposed below or above the monocoque frame. However, in the case where a sufficient space exists in the monocoque frame, the compressed-gas container can be accommodated in the space in the monocoque frame.

(9) In the first embodiment, as shown in FIGS. 2 and 6, the pressure regulating valve 85 is attached to the compressed-gas container 33. Alternatively, the pressure regulating valve 85 can be attached to the member, such as the internal combustion engine 9 and the main frame 2, which is different from the compressed-gas container 33.

(10) The gas with which the compressed-gas container 33 is filled is not limited to the air, but other gases such as nitrogen can be used.

(11) In the case where the V-type internal combustion engine is mounted as shown in FIG. 13, the position where the compressed-gas container 33 is disposed is not limited to the range within the V-bank, the present invention shall include the structure in which the compressed-gas container 33 is disposed within at least the outermost line of the body component such as the body frame.

(12) In the present invention, a valve-operating mechanism including a tappet can be used as the valve-operating mechanism instead of the rocker arm of FIG. 3.

(13) The present invention is not limited to the structures of the above-described embodiments, but those skilled in the art can make various modifications and changes without departing from the scope of the appended claims.

What is claimed is:

1. A motorcycle provided with a valve-operating mechanism for actuating a valve which opens and closes a combustion chamber of an internal combustion engine, wherein the valve-operating mechanism includes a biasing means for biasing the valve toward a valve closing direction and a drive means for driving the valve toward the valve opening direction against the biasing means, the biasing means is a gas spring formed by filling a gas spring chamber with compressible gas, and a compressed-gas container for supplying the compressible gas is connected to the gas spring chamber, and the compressed-gas container is disposed in an outermost line of body components of the motorcycle except for the compressed-gas container when the motorcycle is viewed from above.

2. The motorcycle provided with the valve-operating mechanism according to claim 1, wherein the compressed-gas container is disposed in a region opposite to a side to which an exhaust pipe line of a cylinder of the internal combustion engine is connected.

3. The motorcycle provided with the valve-operating mechanism according to claim 2, wherein the compressed-gas container is disposed in a rear portion of the cylinder of the internal combustion engine when the motorcycle is laterally viewed.

4. The motorcycle provided with the valve-operating mechanism according to claim 2, wherein the internal combustion engine is a V-type internal combustion engine in which a front cylinder and a rear cylinder are arranged into a V-shape, and the compressed-gas container is disposed between the front cylinder and the rear cylinder when the motorcycle is laterally viewed.

5. The motorcycle provided with the valve-operating mechanism according to claim 2, wherein the compressed-gas container is disposed near a gravitational center of a body of the motor cycle or the internal combustion engine when the motorcycle is laterally viewed.

6. The motorcycle provided with the valve-operating mechanism according to claim 1, wherein the compressed-gas container is disposed at a position where the compressed-gas container overlaps the body components except for the compressed-gas container when the motorcycle is laterally viewed.

7. The motorcycle provided with the valve-operating mechanism according to claim 6, wherein the compressed-gas container overlaps a main frame of the motorcycle as the body component when the motorcycle is laterally viewed.

8. The motorcycle provided with the valve-operating mechanism according to claim 1, wherein the compressed-gas container is disposed within a lateral width of the internal combustion engine.

9. The motorcycle provided with the valve-operating mechanism according to claim 1, wherein a pressure regulating valve regulating a gas pressure in the gas spring chamber, is attached to the compressed-gas container.

10. The motorcycle provided with the valve-operating mechanism according to claim 1, wherein a second biasing means for utilizing a restoring force of an elastic material to bias the valve of the combustion chamber toward the valve closing direction is disposed in the gas spring chamber in addition to the biasing means in which the compressible gas is used.

11. The motorcycle provided with the valve-operating mechanism according to claim 1, wherein a gas feeder for supplying the gas to the compressed-gas container is provided, with power generated by running of the internal combustion engine being used as a drive source.

12. The motorcycle provided with the valve-operating mechanism according to claim 11, wherein the valve and the gas feeder are configured to be driven by a common cam portion formed on a valve driving cam shaft of the combustion chamber.

13. The motorcycle provided with the valve-operating mechanism according to claim 11, wherein a relief valve is connected to the compressed-gas container, the relief valve preventing a pressure of the compressed-gas container from exceeding a setting range.

14. The motorcycle provided with the valve-operating mechanism according to claim 1, wherein a supply pipe capable of injecting the gas is connected to the gas spring chamber in addition to the compressed-gas container.

15. A motorcycle provided with a valve-operating mechanism for actuating a valve which opens and closes a combustion chamber of an internal combustion engine, wherein the valve-operating mechanism includes a biasing means for biasing the valve toward a valve closing direction and a drive means for driving the valve toward the valve opening direction against the biasing means, the biasing means is an gas spring formed by filling a gas spring chamber with compressible gas, and a compressed-gas container for supplying the compressible gas is connected to the gas spring chamber, a passage forming means for forming a gas passage is connected to the compressed-gas container in order to guide the gas to be filled to the gas spring chamber, and the compressed-gas container is disposed such that a compressed-gas container projection region is located inside an outer-shell projection region in a lateral direction of the motorcycle, the compressed-gas container projection region indicating an outer shape of the compressed-gas container projected to a virtual plane perpendicular in a fore-and-aft direction of the motorcycle, the outer-shell projection region being obtained by projecting one or more body component except for the compressed-gas container to the virtual plane.

* * * * *